US005136790A

United States Patent [19]

Hagen et al.

[11] Patent Number: 5,136,790

[45] Date of Patent: Aug. 11, 1992

[54] METHOD AND APPARATUS FOR DRYING COATED WEBS

[75] Inventors: Kenneth G. Hagen, Cape Elizabeth, Me.; James R. Bowden, N. Scituate, R.I.

[73] Assignee: Thermo Electron-Web Systems, Inc., Auburn, Mass.

[21] Appl. No.: 666,857

[22] Filed: Mar. 7, 1991

[51] Int. Cl.[5] ..... F26B 3/00

[52] U.S. Cl. ..... 34/23; 34/51; 34/156; 34/32; 34/79

[58] Field of Search ..... 34/155, 156, 51, 79, 34/23, 32, 36, 54, 79

[56] References Cited

U.S. PATENT DOCUMENTS

| | | | |
|---|---|---|---|
| 4,164,819 | 8/1979 | Devillard | 34/32 |
| 4,231,165 | 11/1980 | Gresens et al. | 34/32 |
| 4,337,582 | 7/1982 | Smith | 34/32 |
| 4,343,769 | 8/1982 | Henkelmann | 34/32 |
| 4,475,294 | 10/1984 | Henricks | 34/79 |
| 4,575,952 | 3/1986 | Bodenan et al. | 34/156 |
| 4,894,927 | 1/1990 | Ogawa et al. | 34/32 |
| 4,942,676 | 7/1990 | Wimberger et al. | 34/51 |

*Primary Examiner*—Henry A. Bennet
*Assistant Examiner*—Denise L. F. Gromada
*Attorney, Agent, or Firm*—Samuels, Gauthier & Stevens

[57] ABSTRACT

A method and apparatus for drying a continuously moving web carrying a liquid, wherein the web is passed through a dryer in which the web is exposed to a recirculating flow of heated drying gas. Exhaust gas is diverted and discharged from the recirculating gas flow at a flow rate which is variable between maximum and minimum levels, and makeup gas is added to the recirculating gas flow at a flow rate which is also variable between maximum and minimum levels. A process variable is sensed and compared to a selected set point. A first of the aforesaid flow rates is adjusted to maintain the process variable at the selected set point, and a second of the aforesaid flow rates is adjusted in response to adjustments to the first flow rate in order to insure that the first flow rate remains between its maximum and minimum levels.

13 Claims, 6 Drawing Sheets

METHOD AND APPARATUS FOR DRYING COATED WEBS

BACKGROUND AND SUMMARY OF THE INVENTION

This invention relates generally to coated web drying systems, and is concerned in particular with an improved method and apparatus for controlling the operation of convective air dryers employed in such systems.

A conventional flotation-type convective air dryer is diagrammatically illustrated at 10 in FIG. 1. The dryer comprises an insulated housing 11 defining a drying chamber 12 with communicating entry and exit slots 14, 16. A coated paper web 18 enters the housing through slot 14, passes through the drying chamber 12, and exits the housing through slot 16. Heated air is delivered to supply ducts 20 within the dryer at locations above and below the web 18. Each supply duct communicates with a plurality of headers 22 which in turn communicate with nozzles indicated typically at 24. The nozzles apply heated drying air to opposite sides of the web 18. The air picks up moisture evaporating from the web before exiting from the housing via exhaust ducts 26. From here, the moisture laden air is collected, partially diverted and exhausted, and partially recycled, with the recycled air being reheated before being returned to the dryer via the supply ducts 20.

The staggered arrangement of the nozzles induces a sinusoidal-like wave shape to the web as it passes through the dryer. This provides a measure of cross-machine rigidity which flattens mild ripples and enables the web to resist edge curl.

The dryer 10 of FIG. 1 is typically associated with an external air system of the type illustrated diagrammatically in FIG. 2. The system includes a burner chamber 28 or other like heat generator in which combustion air ($M_{ca}$) and fuel ($M_F$) are admitted for combustion. Heated drying air is withdrawn from chamber 28 by a recirculation fan 30 and is directed via conduits 32, 34 to the supply ducts 20. Moisture laden return air is carried from the exhaust ducts 26 back to the chamber 28 via conduits 36, 38. An air exhaust fan 40 communicates with conduit 38 via conduit 42 and serves to divert and remove exhaust air ($M_E$) from the system. Makeup air ($M_{MU}$) is added to the combustion chamber via conduit 44. Flow control devices such as for example dampers 46, 48, 50 respectively control the flow rates of makeup air, drying air and exhaust air.

If the air pressure within the dryer (commonly referred to as "box pressure") is allowed to exceed ambient air pressure, hot air will exfiltrate or "puff" from the dryer through the entry and exit slots 14, 16. Conversely, if box pressure is allowed to drop below ambient air pressure, cold air will infiltrate into the dryer through the slots 14, 16. Infiltration or exfiltration of air is designated at $M_I$, whereas moisture being evaporated from the web is shown at $M_W$. The dryer is considered to be "balanced" when there is no infiltration or exfiltration of air through the entry and exit slots.

Exfiltration produces an unacceptable discharge of hot process air into the work environment. This condition is easily recognizable, and often remedied by purposely depressing box pressure to induce infiltration. However, infiltration also results in serious drawbacks, including wasted fuel, loss of dryer capacity and degradation of paper quality. In the past, those skilled in the art either have misunderstood the negative consequences of infiltration, or have chosen to accept them as necessary corollaries to the avoidance of exfiltration.

Maintaining dryer balance requires a carefully coordinated adjustment of both the exhaust and makeup air dampers. The majority of prior art installations do not lend themselves to this level of sophistication. Often, the dampers are manually adjustable, and not readily accessible, thus discouraging operating personnel from achieving and maintaining optimum settings.

During the last decade, some effort has been directed to automating control of the makeup air and exhaust dampers. For example, in U.S. Pat. No. 4,591,517 (Whipple et al), one control loop automatically adjusts the setting of the makeup air damper in response to fluctuations of box pressure above and below ambient air pressure. A second control loop adjusts the setting of the exhaust damper in response to changes in another process variable, e.g., the amount of ink or other liquid being applied to the web. However, because these control loops are not integrated one with the other, the possibility exists that one or the other of the dampers may be adjusted to a fully open or fully closed position. As will hereinafter be described in greater detail, when this occurs, the air system is no longer in control, which in turn means that the dryer is likely to drift into an unbalanced condition.

An objective of the present invention is to avoid the drawbacks of the prior art by providing an improved method and apparatus for continuously and automatically maintaining the dryer in a balanced state.

A companion objective of the present invention is to coordinate adjustments to flow control devices such as the makeup air and exhaust dampers in a manner which avoids either damper from being adjusted to an extreme setting, e.g., fully open or fully closed.

Another objective of the present invention is the provision of a method and apparatus for automatically maintaining the dryer in a balanced state while at the same time automatically controlling other process variables, e.g., fuel consumption, web temperature, etc.

Still another objective of the present invention is the provision of a method and control system for automatically readjusting process set points that might otherwise require the makeup air and/or exhaust air flow control devices to be adjusted to extreme settings, or would require such flow control devices to be adjusted such that preselected high and low limits of another process variable would be exceeded.

Another objective of the present invention is the provision of a method and control system for overriding existing settings of makeup air and/or exhaust flow control devices and forcing such devices to different settings when operating in non-drying modes, e.g., during purge cycles.

These and other objects and advantages of the present invention will now be described in greater detail with further reference to the accompanying drawings, wherein:

DESCRIPTION OF PREFERRED EMBODIMENT

Figure 1:
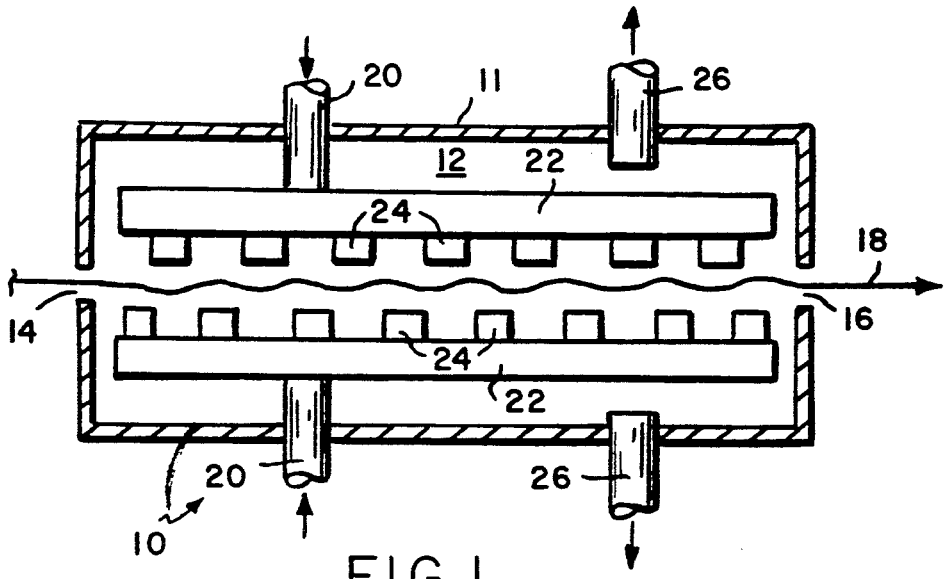
FIG. 1 is a diagrammatic illustration of a conventional flotation-type dryer.
Figure 2:
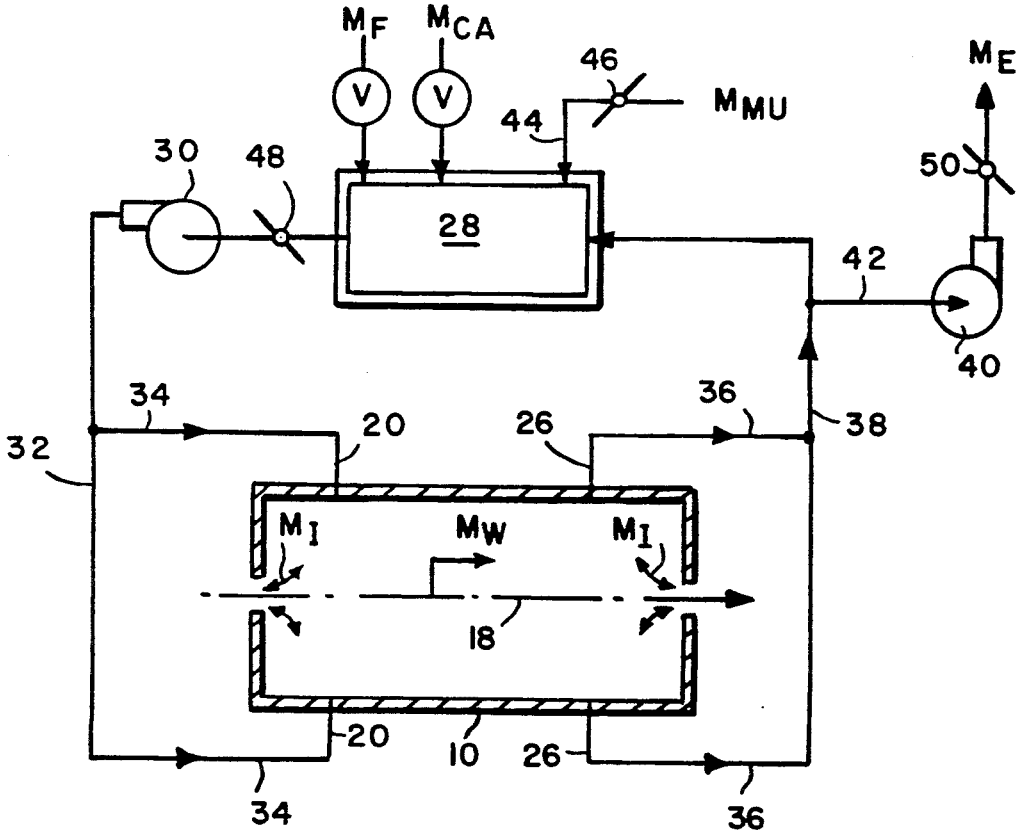
FIG. 2 is a diagrammatic illustration of an external air system used in conjunction with the dryer shown in FIG. 1.

Referring again to FIG. 2, it will be seen that the following six flows are involved in balancing the dryer:

$M_E$—Exhaust air
$M_F$—Fuel (usually gas)
$M_{CA}$—Combustion air
$M_W$—Water evaporation from the web
$M_{MU}$—Makeup air
$+M_I$—Infiltration (slot flow)
$-M_I$—Exfiltration (slot flow)

and they are related by the following mass balance equation:

$$M_E = -M_F + M_{CA} + M_W + M_{MU} \pm M_I \quad (1)$$

The last term is a consequence of imperfect balancing, i.e., positive infiltration or negative exfiltration, and the objective of the present invention is to minimize and optimally eliminate it from the equation. It will be understood that where the recirculating flow of drying air is being heated by non combustion means such as for example steam coils, $M_F$ and $M_{CA}$ also are eliminated from the equation.

It will be seen from an examination of this equation that the makeup air and exhaust dampers 46, 50 must work in concert if the balance of the dryer is to be maintained for all operating conditions. For example, increasing the drying rate infers an increase in the fuel, combustion air and evaporation flows. Thus, for a given exhaust flow, the makeup air must be reduced as the drying rate is increased. Also, using the exhaust damper as a primary process control requires that the makeup air damper be correspondingly adjusted. Otherwise, infiltration or exfiltration will result.

Although maintaining the dryer in a balanced state should be the first priority of a properly operated system, other process variables including for example fuel consumption, web temperature, humidity level within the dryer, etc., are also deserving of attention. Fuel consumption can be effected by controlling the amount of unheated makeup air being added to the system. Humidity level within the dryer, which in turn affects web temperature, is likewise affected by controlling the amount of exhaust air being removed from the system. In any drying operation, variations in ambient air temperature, incoming web temperature, the amount of liquid being evaporated from the web, etc., will require makeup air and exhaust dampers to modulate continuously above and below initial settings made during start up. Thus, in the example illustrated by curve 74 in FIG. 3, when operating with the makeup air damper "nearly closed" in order to achieve fuel efficiencies, the system will remain in control as long as the damper remains capable of controlling makeup air flow. However, between points 74*a* and 74*b*, the damper is fully closed, thus throwing the system out of control. As depicted by curve 76, a similar situation can exist when the damper is operating at a "nearly open" setting. Here, between points 76*a* and 76*b*, the damper is fully open and the system is again out of control.

The present invention automatically prevents the makeup air and exhaust dampers from reaching their fully open or fully closed positions in response to process requirements, thereby insuring that the system remains in control at all times.

Figure 4:
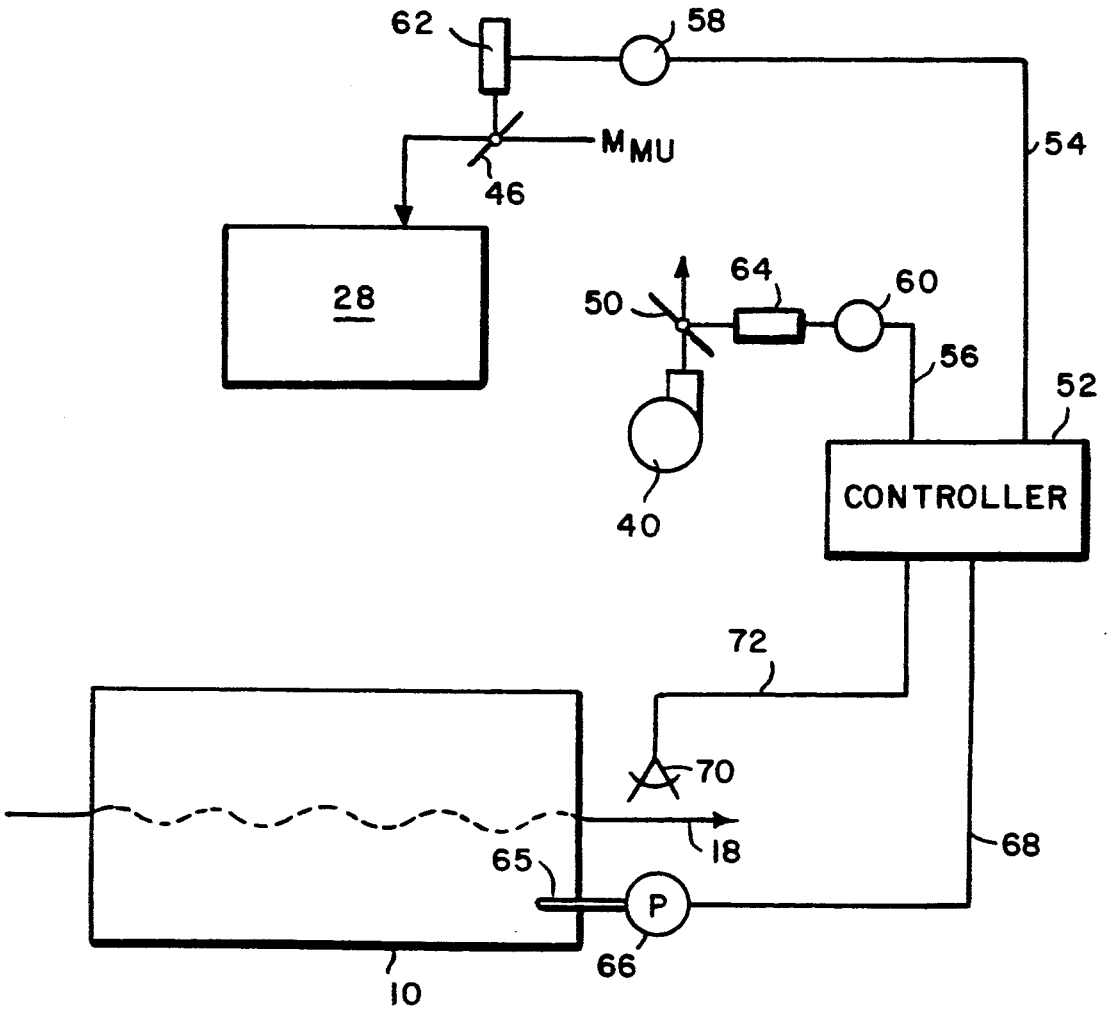
FIG. 4 is a diagrammatic illustration of a control system in accordance with the present invention.

In order to achieve the foregoing, and with reference to FIG. 4, it will be seen that the present invention includes a control system having a microprocessor-based controller 52 connected via line 54 and current/-pressure transducer 58 to a linear actuator 62 used to adjust the makeup air damper 46. Controller 52 is similarly connected via line 56 and current/pressure transducer 60 to a linear actuator 64 used to adjust the exhaust damper 50. The probe 65 of a pressure transducer 66 senses box pressure. The output of transducer 66 is connected via line 68 to the controller 52.

The function of the control system is to maintain the dryer in a continuously balanced state within the high and low limits of secondary physical parameters, other tertiary physical parameters, e.g., fuel consumption, web temperature, humidity, etc. through automatic adjustments to the makeup air and exhaust dampers 46,50. Adjustments are determined by the controller 52 on the basis of a proportional integral derivative ("PID") algorithm. The controller compares a process variable with a preselected set point to determine any difference or error therebetween, and outputs a control signal to the appropriate damper in order to eliminate the error. The PID algorithm is expressed as follows:

$$O = PE + I\int Edt + D(dE/dt) + Op$$

Where:

O=output
Op=prior output
E=error (the difference between a set point and a process variable)
P=Tuning parameter of the proportional component of the equation (The result is proportional to the size of E).
I=Tuning parameter of the integral component of the equation. (The result is a function of the sum of E over time).
D=Tuning parameter of the derivative component of the equation (The result is a function of the rate of change of E).

As previously noted, the present invention is concerned primarily with maintaining the dryer in a continuously balanced state while operating in a drying mode. Secondary and additional priorities also may be addressed in various operational strategies. Two examples of operations in a drying mode and one example of operation in a non-drying mode will now be described.

Figure 5:
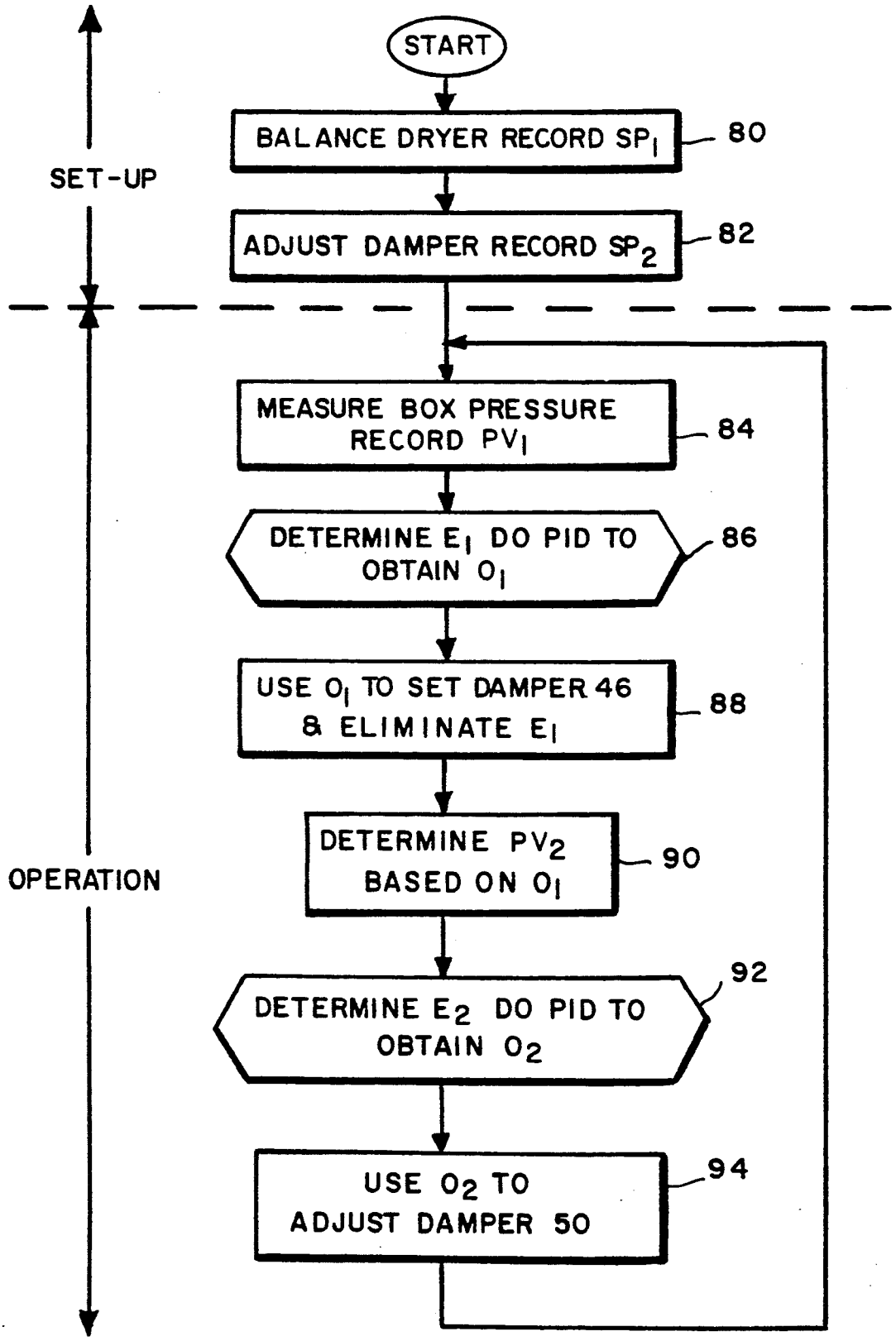
FIG. 5 is a flow chart depicting one operational strategy for the control system of the present invention.

FIG. 5 is a flow chart illustrating an operational strategy for the control system when maintaining the dryer in a balanced state is the first priority and achieving optimum fuel economy is the second priority. The flow chart is subdivided into a set-up phase and an operational phase.

During set-up, and as indicated at functional block 80, operating personnel initially balance the dryer, and then measure and record the box pressure as a first process set point ("$SP_1$"). This procedure usually entails manually adjusting the makeup air and exhaust dampers, with the use of smoke sticks or the like to detect the presence or absence of air flow into or out of the entry and exit slots 14, 16.

Next, as depicted at functional block 82, the makeup air damper 46 is shifted to its automatic operational mode, and the exhaust air damper 50 is manually throttled down. Because the makeup air damper is in its automatic operational mode, it too will be throttled down automatically by the control system in order to balance the dryer. Manual throttling down of the exhaust damper will continue until the makeup air damper has reached a "nearly closed" setting, thereby minimizing the addition of cold makeup air to the system, which in turn minimizes fuel consumption. This setting of the makeup air damper is recorded in the controller 52 as a second set point ("$SP_2$").

It will be understood that controller 52 is programmed to process information and to output control signals in accordance with the previously described PID algorithm. During continued operation of the drying system, and as depicted at functional block 84, probe 65 measures box pressure and the pressure transducer 66 transmits a representative signal which is received by the controller as a first process variable ("$PV_1$").

As indicated at functional block 86, the controller then performs the PID calculation based on the difference or error $E_1$ between $SP_1$ and $PV_1$ to arrive at an appropriate output $O_1$. $O_1$ is then used to correct the setting of the makeup air damper 46 in order to bring $PV_1$ to $SP_1$, i.e., to maintain the dryer in a balanced state. Of course, if $E=O$, then $O_1$ equals $O_p$, and the setting of the makeup air damper will remain unchanged.

It will be seen, therefore, that the controller 52 operates in conjunction with the pressure probe 65 and pressure transducer 66, as well as with the current/pressure transducer 58 and linear actuator 62 to form first control loop operating in response to fluctuations in box pressure to adjust the makeup air damper 46 and thereby maintain the dryer in balance. Because the makeup air damper was purposely set at a nearly closed setting in order to conserve fuel, there remains the possibility that it may reach a fully closed setting (between points 74*a*, 74*b* in FIG. 3).

In order to prevent this from happening, and as indicated at functional block 90, the output $O_1$ is considered by the control system as being indicative of the current makeup air damper setting, and is employed by the controller as a second process variable ("$PV_2$").

Figure 3:
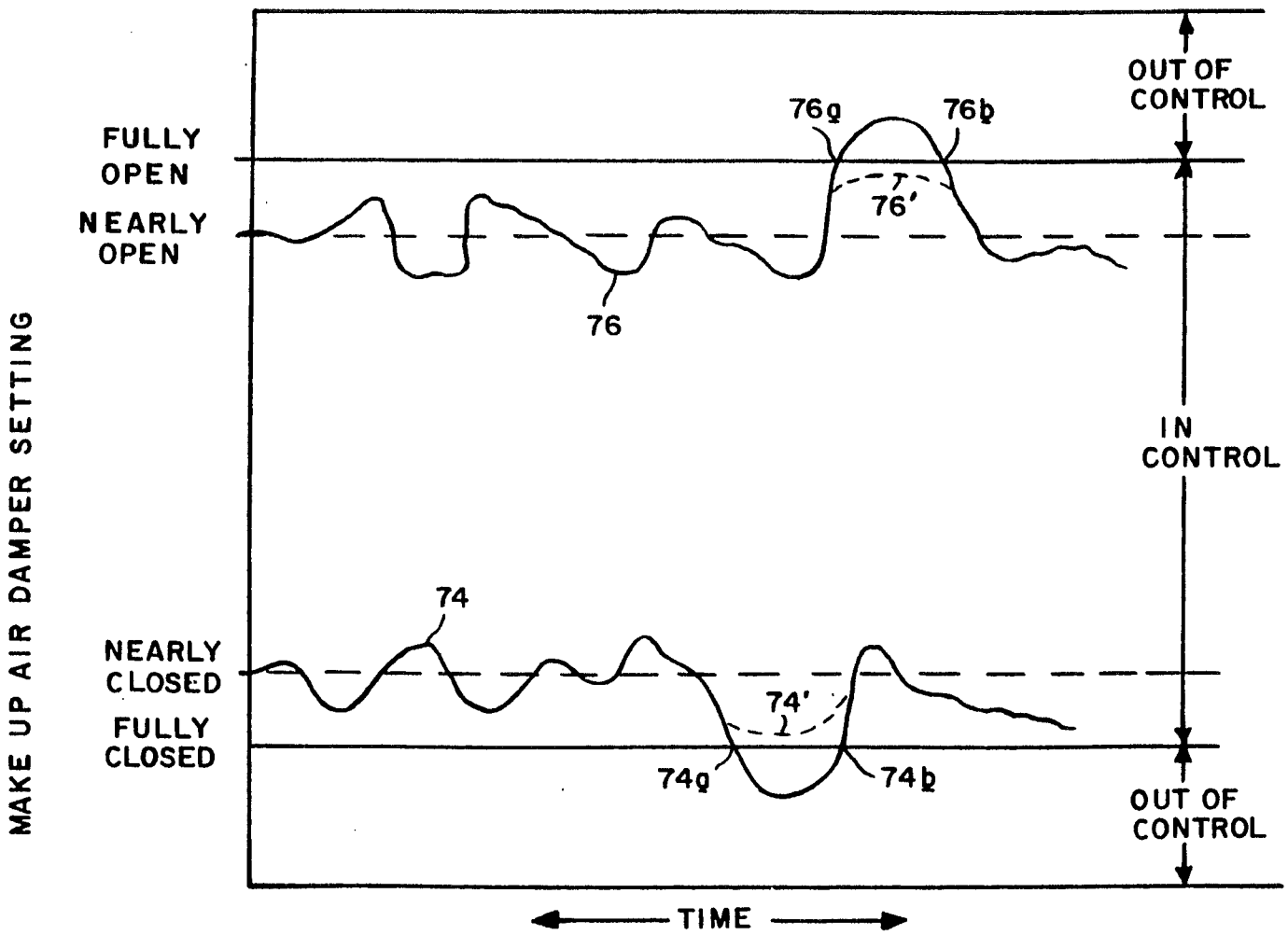
FIG. 3 is a graph depicting variations in the setting of a makeup air damper.

The controller again performs the PID calculation (functional block 92) based on the difference or error $E_2$ between $SP_2$ and $PV_2$ to arrive at a second output $O_2$ which is used to make any necessary correction to the exhaust damper 50. Such corrections will open the exhaust damper 50 to create an increased demand for makeup air when the makeup air damper 46 is in danger of being fully closed. With reference to FIG. 3, this will cause the curve 74 to be redirected along the dotted path 74', thereby keeping the dryer within the "In Control" range.

Thus, the controller 52 operates in conjunction with current/pressure transducer 60 and linear actuator 64 to form a second control loop which operates in response to the output of the first control loop in making corrective adjustments to the exhaust damper 50. The two control loops are integrally associated one with the other in a manner which avoids the makeup air damper from being fully closed. In light of the foregoing, it will be understood that the same logic and operational procedures will serve to prevent the makeup air damper from being fully opened by closing down the exhaust damper to redirect curve 76 along dotted path 76' (see FIG. 3).

Figure 6:
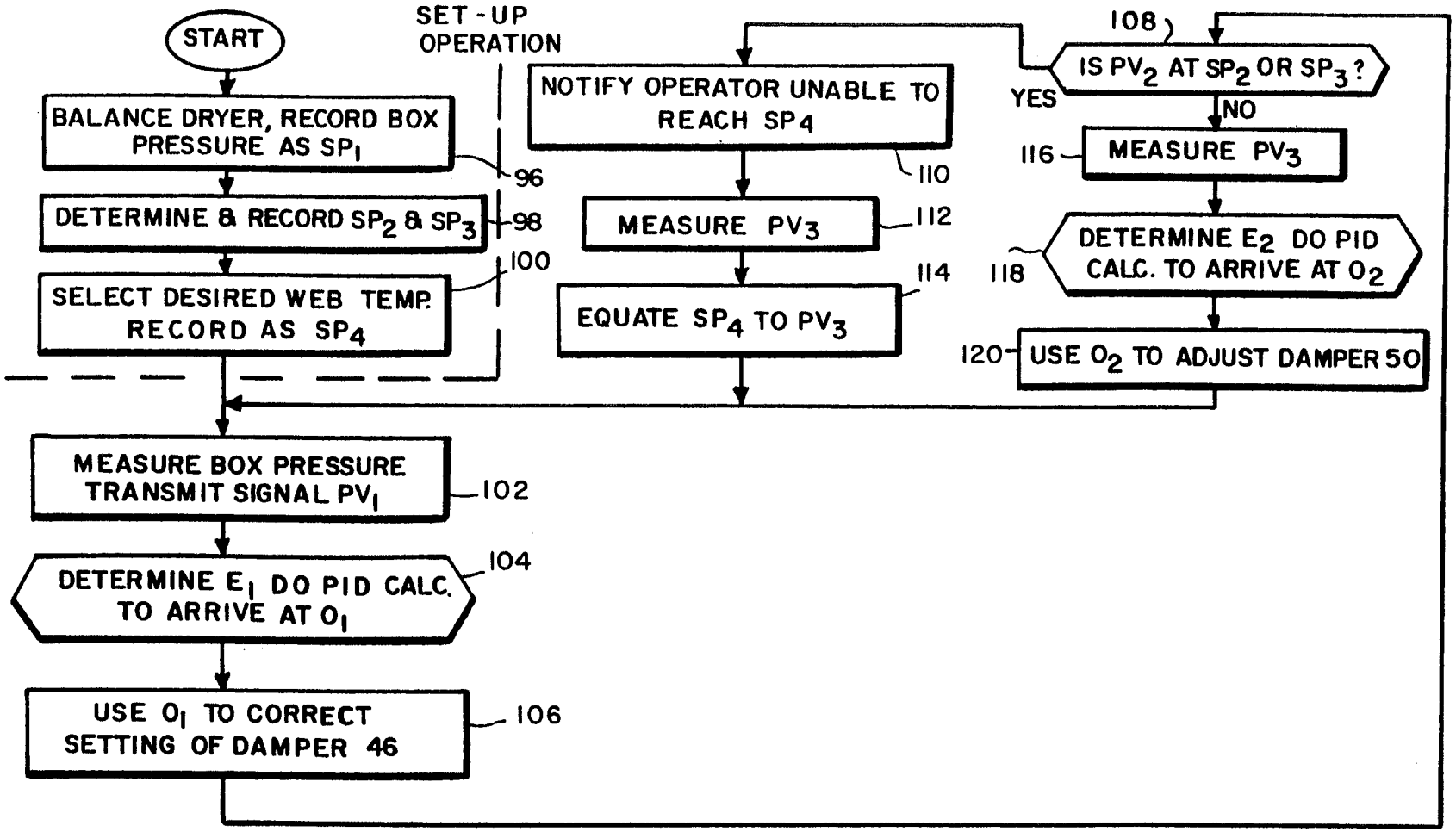
FIG. 6 is a flow chart depicting another operational strategy.

FIG. 6 is a flow chart illustrating a different operational strategy where maintaining a preselected web temperature is the second priority, the first priority again being maintenance of the dryer in a balanced state. Here, as shown in FIG. 4, the control system additionally utilizes a web temperature sensor 70 positioned adjacent to the exit slot of the dryer. Sensor 70 generates a signal representative of web temperature which is transmitted to the controller 52 via line 72. Returning now to FIG. 6, functional block 96 again entails manually balancing the dryer and recording a first set point $SP_1$ representative of box pressure in the balanced state. Operating personnel then select set points ("$SP_2$") and ("$SP_3$") (functional block 98). These set points are respectively representative of the nearly closed and nearly open settings of the makeup air damper 46. Next, as indicated at functional block 100, a desired web temperature is selected and recorded as a fourth set point ("$SP_4$").

During the operational phase, the first control loop again measures box pressure and transmits a representative signal to the controller as a first process variable $PV_1$ (functional block 102). Controller 52 then determines $E\ (SP_1-PV_1)$ and performs the PID calculation to arrive at a first output $O_1$ (functional block 104). $O_1$ is then used to make needed corrections to the makeup air damper 46 in order to maintain the dryer in a balanced state (functional block 106).

As indicated at functional block 108, $O_1$ is then employed by the controller as a second process variable $PV_2$ indicative of the current setting of the makeup air damper, and a determination is made as to whether $PV_2$ is at either of the physical limits defined by $SP_2$ and $SP_3$. A "Yes" determination triggers a signal (functional block 110) warning operating personnel that the system cannot achieve the desired web temperature set point $SP_4$ without causing the dryer to become unbalanced. The current web temperature ("$PV_3$") is then measured (functional block 112) and $SP_4$ is automatically reset to equal $PV_3$ (functional block 114). Operation then continues on this basis.

A "No" determination at functional block 108 is followed at functional block 116 by measurement of the web temperature $PV_3$, which is then used to determine the difference $E_2$ between $SP_4$ and $PV_3$. The PID calculation is then performed on the basis of $E_2$ (functional block 118) to arrive at a second output $O_2$. $O_2$ is used to correct the setting of the exhaust damper 50 (functional block 120), after which the system recycles.

Thus, it will be seen that with this operational strategy, a balanced dryer is again the first priority, and maintenance of a selected web temperature is a second priority, the latter being automatically reset in the event that the first priority is placed in jeopardy.

The logic of this example can be extended further to enable the preselected high and low limits of a third process parameter, e.g., humidity, fuel usage, etc. to function as the physical limits of the makeup air damper do in functional block 108. In such a case, the balanced dryer is the first priority, not exceeding the high and low limits of the third process parameter is the second priority, and maintenance of a selected web temperature is the third priority. The web temperature set point will automatically reset in the event that the first or second priorities are placed in jeopardy.

Figure 7:
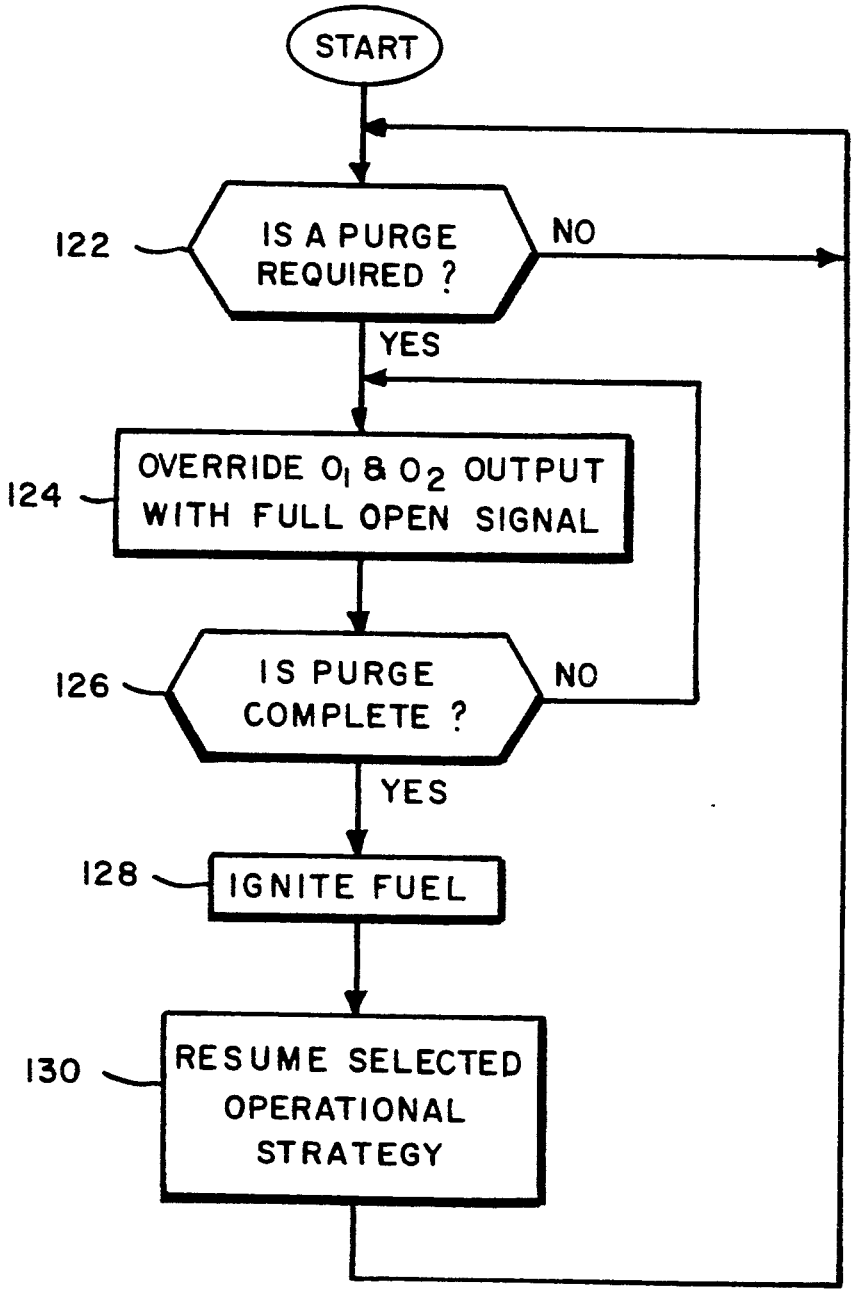
FIG. 7 is a flow chart depicting still another operational strategy.

It will be understood that there are several non-drying modes of operation for a dryer, including for example "idle", "purge", and "bypass". A purge sequence is illustrated by the flow chart of FIG. 7. Here, the only priority is purging the dryer, associated ducting and burner chamber with fresh air before igniting the fuel required to heat the recirculating flow of drying air.

The test of functional block 122 determines whether a purge is required. A negative determination recycles the loop. A positive determination overrides the existing operating signals $O_1$ and $O_2$ of the makeup air damper 46 and exhaust air damper 50 (functional block 124) to fully open both dampers to maximize the flow of fresh air through the system. A second test (functional block 126) determines if the purge is complete. A negative determination recycles through functional block 124 to continue the purge. A positive determination triggers fuel ignition (functional block 128) and resumption of normal operation (functional block 130).

Thus, control signals normally dictating the settings of the makeup air and exhaust air dampers are overridden when a safety limit is encountered. While the "purge" cycle has been used as an illustration, those skilled in the art will appreciate that other non-drying operational modes such as "idle" and "bypass" can be similarly accommodated.

In light of the foregoing, it will now be appreciated by those skilled in the art that changes and modifications to the embodiments herein disclosed can be made without departing from the spirit and scope of the invention. For example, instead of controlling air flow by adjustable dampers, variable speed fan drives may be employed. Where dampers are employed, they may be located either upstream or downstream from associated fans. The dampers may be adjusted by motors rather than piston cylinder units. Also in certain drying applications, inert gases such as nitrogen may be used in place of air as the drying medium.

In summary, therefore, the present invention offers a level of control sophistication well above that offered by the prior art. When operating in a drying mode, a balanced dryer is assured while controlling other process variables, with provisions being made to automatically readjust set points that cannot be achieved without causing the system to drift out of control. Set points may be automatically overridden when shifting to non-drying operational modes.

We claim:

1. A method of drying a continuously moving web carrying a liquid, comprising:

(a) passing the web through an enclosed dryer via entry and exit slots communicating therewith:

(b) recirculating a flow of drying gas between and through said dryer and a heater associated therewith, with the drying gas passing through said chamber being applied to said web to evaporate the liquid carried thereon;

(c) supplying thermal energy to the drying gas passing through said heater in variable amounts to heat said drying gas to a selected temperature;

(d) diverting and discharging exhaust gas from said recirculating flow at a flow rate which is variable between maximum and minimum levels;

(e) adding makeup gas to said recirculating flow at a flow rate which is variable between maximum and minimum levels;

(f) sensing at least a first process variable;

(g) establishing a first set point for said first process variable; and (h) adjusting one of said flow rates in order to maintain said process variable at said first set point, and adjusting the other of said flow rates in response to adjustments to said one flow rate and in a manner which insures that the said one flow rate remains between its maximum and minimum levels.

2. The method of claim 1 wherein said first process variable is the gas pressure inside said dryer, and said first set point is a pressure value selected such that infiltration and/or exfiltration through said entry and exit slots is controlled to achieve a balanced condition.

3. The method of claim 2 wherein the flow rates of said makeup gas and discharge gas are controlled respectively by first and second adjustable devices, wherein said first device is adjusted in response to differences between said first process variable and said first set point, and wherein said second device is adjusted in response to changes in the setting of said first device.

4. The method of claim 3 wherein said first and second devices comprise dampers.

5. The method of claim 4 wherein said first damper is maintained at a nearly closed position in order to minimize the amount of thermal energy required to heat said drying gas, and wherein said second damper is adjusted in response to the setting of said first damper to discharge exhaust gas at a rate requiring continued addition of makeup gas.

6. The method of claim 3 further comprising sensing of a second process variable, establishing a second set point for said second process variable, and adjusting the setting of said second device in order to maintain said second process variable at said second set point.

7. The method of claim 3 further comprising reestablishing said second set point at the current value of said second process variable in the event that said second process variable cannot be brought to said second set point without adjusting either or both of said devices to settings achieving either maximum or minimum flow rates.

8. The method of claim 7 further comprising determining a third process variable, establishing high and low limits for said third process variable, and reestablishing said second set point at the current value of said second process variable in the event that said second process variable cannot be brought to said second setpoint without exceeding the high and low limits of said third process variable.

9. The method of claim 1 further comprising the step of responding to non-drying operational requirements by automatically overriding said set point and readjusting said flow rates without regard to their maximum and minimum levels.

10. The method of claim 9 wherein said flow rates are automatically readjusted to their maximum levels.

11. Apparatus for drying a continuously moving web carrying a liquid, said apparatus comprising:

(a) a housing enclosing a drying chamber, said housing having entry and exit slots through which said web may be passed through said drying chamber;

(b) a heating chamber;

(c) means for recirculating a flow of drying gas between and through said drying chamber and said heating chamber;

(d) means for supplying thermal energy in variable amounts to the drying gas passing through said heating chamber to heat said drying gas;

(e) makeup means for adding makeup gas to said recirculating flow, said makeup means including a first adjustable device for controlling the flow of said makeup gas between maximum and minimum limits;

(f) exhaust means for diverting and removing exhaust gas from said recirculating flow, said exhaust means including a second adjustable device for controlling the flow of said exhaust gas between maximum and minimum limits;

(g) means for monitoring at least a first process variable and for generating a first input signal representative of said first process variable;

(h) controller means responsive to said first input signal and to a preselected first set point for determining any difference between said first process variable and said first set point, and for generating a first output signal representative of said difference;

(i) means responsive to said first output signal for adjusting said first device to vary the flow of makeup gas in order to adjust said first process variable to said first set point;

(j) said controller being further responsive to said first output signal and to a preselected second set point for generating a second output signal representative of any difference between the current setting of said first device and the preselected second set point; and (k) means responsive to said second output signal for adjusting said second device to accommodate a flow of exhaust gas which requires a compensating flow rate of makeup gas between the maximum and minimum limits thereof.

12. The apparatus of claim 11 wherein said first process variable is internal dryer gas pressure, and said means for monitoring said first process variable includes a pressure probe extending into said drying chamber.

13. The apparatus of claim 11 wherein said adjustable devices comprise dampers.

* * * * *